US006705915B2

(12) United States Patent
Ricaud et al.

(10) Patent No.: US 6,705,915 B2
(45) Date of Patent: Mar. 16, 2004

(54) METHOD OF ASSEMBLING AN EMISSIVE CATHODE FOR ELECTRON GUN

(75) Inventors: Jean-Luc Ricaud, Dijon (FR); Jean-Claude Pruvost, Dijon (FR); Francois Nizery, Torcy (FR); Jean Remy Adamski, Dijon (FR)

(73) Assignee: Thomson Licensing S.A., Boulogne Cedex (FR)

( * ) Notice: Subject to any disclaimer, the term of this patent is extended or adjusted under 35 U.S.C. 154(b) by 67 days.

(21) Appl. No.: 10/168,188

(22) PCT Filed: Dec. 15, 2000

(86) PCT No.: PCT/EP00/12830

§ 371 (c)(1),
(2), (4) Date: Jun. 18, 2002

(87) PCT Pub. No.: WO01/46978

PCT Pub. Date: Jun. 28, 2001

(65) Prior Publication Data

US 2002/0187712 A1 Dec. 12, 2002

(30) Foreign Application Priority Data

Dec. 22, 1999 (FR) ..... 99 16199

(51) Int. Cl.[7] ..... H01J 9/04; H01J 9/12

(52) U.S. Cl. ..... 445/50; 445/51; 445/36; 445/46; 445/49; 313/346 DC; 29/515

(58) Field of Search ..... 445/49, 50, 51, 445/36, 46; 313/346 DC; 29/515

(56) References Cited

U.S. PATENT DOCUMENTS 2,972,078 A * 2/1961 Levi ..... 313/346 DC
4,215,457 A * 8/1980 Kuiper et al. ..... 445/36
4,547,694 A * 10/1985 Himmelbauer ..... 313/346 DC
4,833,361 A 5/1989 Suzuki et al. ..... 313/346
5,128,584 A 7/1992 Choi ..... 313/346

FOREIGN PATENT DOCUMENTS

| | | | |
|---|---|---|---|
| DE | 4140943 | 9/1991 | ..... H01J/1/28 |
| GB | 2262650 | 6/1993 | ..... H01J/1/28 |
| JP | 62-217527 | 9/1987 | ..... H01J/9/04 |
| JP | 2-244533 | 9/1990 | ..... H01J/1/20 |

OTHER PUBLICATIONS

Patent Abstracts of Japan, vol. 012, No. 077, Mar. 10, 1988 and JP 62–217527.

Patent Abstracts of Japan, vol. 014, No. 560, Dec. 13, 1990 And JP 02–244533.

* cited by examiner

*Primary Examiner*—Kenneth J. Ramsey
*Assistant Examiner*—Mariceli Santiago
(74) *Attorney, Agent, or Firm*—Joseph S. Tripoli; Joseph J. Laks; Carlos M. Herrera

(57) ABSTRACT

A process for assembling a cathode for electron gun comprising a body of emissive material, a cup into which the body of emissive material is inserted, a substantially cylindrical metal skirt, the said process comprising the following successive steps:

insertion of the cup into one of the open ends of the metal skirt, welding of the cup to the skirt, crimping of the body/cup/skirt assembly by lateral squeezing at the level of the weld zone in such a way as to cause an indent-like deformation of the lateral face of the body.

5 Claims, 3 Drawing Sheets

METHOD OF ASSEMBLING AN EMISSIVE CATHODE FOR ELECTRON GUN

This application claims the benefit under 35 U.S.C. §365 of International Application PCT/EP00/12830, filed Dec. 15, 2000, which was published in accordance with PCT Article 21(2) on Jun. 28, 2001 in English; and which claims benefit of French Patent Application Serial No. 9916199 filed Dec. 22, 1999.

BACKGROUND OF THE INVENTION

The invention relates to a process for assembling a cathode for electron gun, which process is more particularly suitable for a so-called impregnated cathode.

An impregnated cathode comprises an emissive part in the form of a porous substance made of a refractory material (tungsten, molybdenum, rhenium) impregnated with an electron emitting material (barium, strontium, calcium, aluminium, scandium, osmium, etc.), of a metal cup into which the porous emissive substance is inserted and of a metal sleeve manufactured from a refractory material such as molybdenum, tantalum or tungsten, which sleeve is also referred to as the cathode skirt. The cup containing the emissive substance is disposed at one of the ends of the sleeve. Inserted at the other end of the sleeve is the filament for heating the cathode, which filament raises the said emissive part of the cathode to a temperature of around 1000° C. during its operation.

The cup is generally made from a refractory material such as tantalum or molybdenum; it makes it possible to insulate the emissive part of the heating filament so that the materials emitted during the operation of the cathode by the emissive part cannot pollute the filament and destroy the insulating coating of the latter, causing the destruction of the said filament, and consequently that of the cathode itself.

The impregnated body constituting the emissive substance of the cathode must remain in contact with the metal surface of the cup so as to optimize the thermal efficiency of the cathode. Poor contact, leaving gaps between the opposite surfaces of the impregnated body and of the cup, reduces this thermal efficiency, this having the consequence of reducing the current density which the said cathode can emit. Moreover, poor contact between the body and the cup will cause dispersions of unacceptable emission characteristic when these cathodes are for example inserted in threes into electron guns for colour cathode-ray tube. Now, owing in fact to the materials used, it is difficult to immobilize the impregnated porous body in its cup either by soldering or by welding, in a reliable manner with sufficient repeatability.

Several solutions are described in the state of the art for solving this difficulty. Patent EP 272881 describes the use of Rhenium wires disposed between the body and the cup so as to improve the welding of these two elements. U.S. Pat. No. 5,128,584 describes a process in which the impregnation of the porous metal body is carried out after the operation of laser welding of the body and of the cup. Finally, the use of an intermediate piece intended to play the role of an interface improving the welding between the body and the cup is described in the publication entitled "Temperature and cutoff stabilization of impregnated cathodes, published in the proceedings of the "SID 96 digest" for the conferences of the "Society for Information Display" which were held in 1996, as well as in patent application EP 798 758.

All these solutions are expensive and complex to implement especially when the cathodes have very small dimensions, for example of the order of a millimetre for the diameter of the emissive body.

SUMMARY OF THE INVENTION

The invention proposes a simple and economic solution for ensuring perfect retention of the emissive body in its cup devoid of the drawbacks resulting from the use of the techniques described in the prior art.

To achieve this object, the invention relates to a process for assembling a cathode for electron gun, which cathode comprising a body of emissive material, a cup, comprising a bottom and a lateral wall, into which cup is inserted the body of emissive material, and a substantially cylindrical metal skirt, the said process comprising the following successive steps:

- insertion of the cup into one of the open ends of the metal skirt
- welding of the cup to the skirt
- crimping of the body/cup/skirt assembly by lateral squeezing at the level of the weld zone in such a way as to cause an indent-like deformation of the lateral face of the body opposite the lateral wall of the cup.

BRIEF DESCRIPTION OF THE DRAWINGS

The Invention wilt be better understood with the aid of the following description and of the drawings in which.

FIGS. $\mathbf{2}_A$ to $\mathbf{2}_C$ illustrate a first embodiment of the invention.

FIGS. $\mathbf{3}_A$ to $\mathbf{3}_C$ illustrate another second embodiment of the invention.

Figure 4:
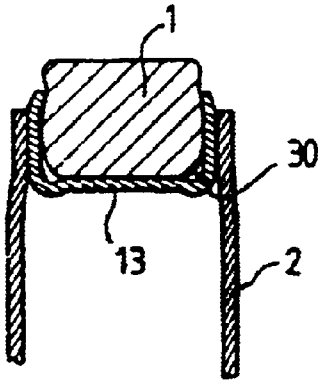

FIG. 4 is a sectional view of an impregnated cathode manufactured according to an assembling process in accordance with the invention and exhibiting an advantageous structure in respect of the implementation of the invention.

DESCRIPTION OF THE PREFERRED EMBODIMENTS

Figure 1:
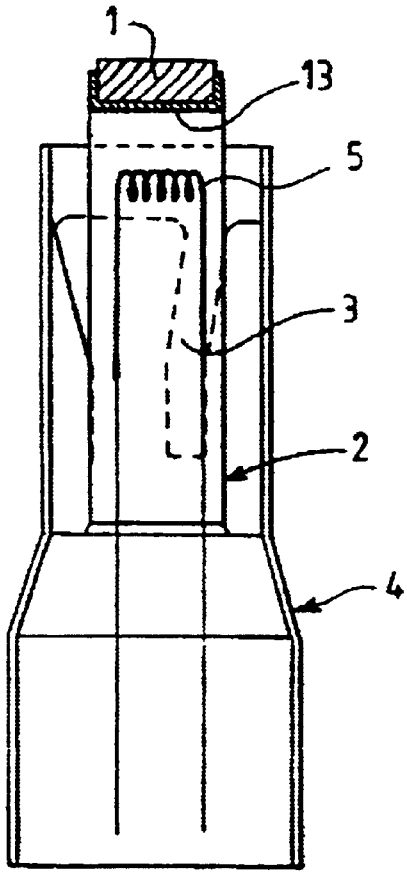
FIG. 1 represents an impregnated cathode according to the prior art.

As indicated in FIG. 1, an impregnated cathode generally comprises a cylindrical skirt 2 at the end of which is the upper part of the cathode composed of the emissive body 1, usually comprising Tungsten as basic material, disposed in its support 13, usually a Tantalum or Molybdenum cup. The heating element 5 is inserted inside the skirt 2. A cylinder serves as thermal shield to avoid the escape of the heat created by the heating element 5, thus increasing the thermal efficiency of the assembly. The cylindrical skirt 2 is retained in position inside the shield 4 by lugs 3 welded both to the skirt 2 and to the thermal screen 4. One of the difficulties relating to the assembling of the various elements of the cathode relates to the bond between the body 1 and its support 13. This bond must be mechanically strong, offer excellent thermal transmission and be neutral with regard to the emission properties of the body, all this at high working temperatures which may exceed 1200° C. The emission stability, lifetime, start-up time and emission threshold stability parameters depend essentially on the mechanical securing of the body to the remainder of the structure of the cathode. Now, since the emissive body and its support are made from refractory materials, it is extremely difficult to bond the two elements directly by welding; the numerous solutions disclosed in the prior art do not moreover offer any simple, reliable and economic solution, with characteristics of repeatability necessary for the industrialization of a key element for a cathode-ray tube. To obtain perfect contact between the refractory metal cup 13 and the emissive body 1, which contact makes it possible to optimize the thermal conduction between the heating element 5 and the body, it is necessary to produce a weld linking the materials together without destroying the porosity of the body and without modifying the emission characteristics, so precluding welding at too high a temperature.

According to an assembling method in accordance with the invention, illustrated by FIGS. $2_A$ to $2_C$ the emissive body 1, consisting for example of porous tungsten obtained by sintering, is inserted into its support, a cup 13 having a flared collar 14 at its periphery; this collar is intended mainly to ease the insertion of the emissive body into the cup. The body/cup assembly is thereafter inserted into one of the open ends of the cathode skirt 2. The collar 14 abuts on the edge of the said end of the skirt 2. The body is retained in a conventional manner in its cup during the welding chase, by being disposed for example between a presser element 21 and a fixed support 22; the presser element will bear on the free surface of the body while the free surface of the cup bears on the fixed support 22. The weld is made at 19, for example by laser beam, preferably at the level of the collar since this is the place where one is certain that the two parts to be welded (2 and 13) are effectively in contact with one another. Indeed, the play required for the insertion of the cup into the cylindrical skirt entails the existence of mechanical play between the two opposite surfaces; during laser welding this play could cause the piercing of the skirt without providing effective welding. Locally, the welding will create a metal bead 23 which will in part flow into the gap between the cup and the skirt.

Several weld points 23 are thus distributed around the end of the skirt 2. In an advantageous configuration, three weld points disposed at 120° to one another ensure good mechanical retention of the cup 13 in the skirt 2.

Figure 2A:
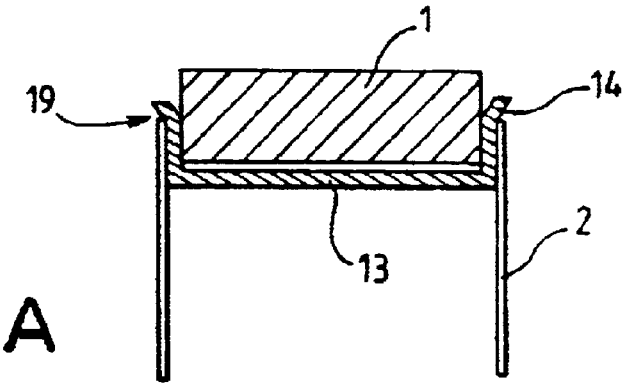
Figure 2B:
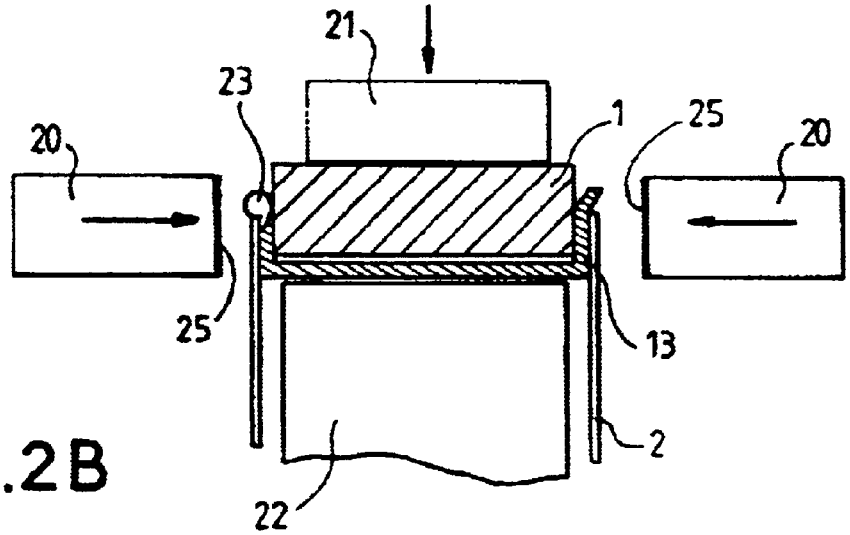

In the subsequent crimping phase, illustrated by FIG. 2B, the emissive body 1/cup 13/skirt 2 assembly is squeezed by presser elements 20 which carry out lateral squeezing of this assembly. The profile of the end 25 of the presser elements which comes to bear on the periphery of the body/cup/skirt assembly has a shape complementary to that of the outside surface of the said assembly.

Figure 2C:
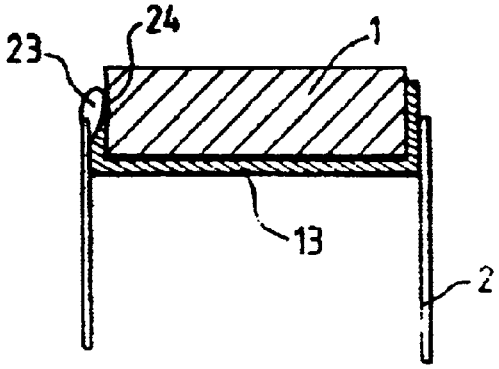

The crimping makes it possible to mate the internal surface of the cup with the entire lateral surface of the body. At the level of the weld points, the crimping, owing to the excess matter constituting the bead 23, will cause a local indent-like deformation 24 of the porous body 1. This deformation will anchor the weld bead in the lateral wall of the body and mechanically fasten the latter inside the cup as shown by FIG. 2C.

This method allows a simple final check by monitoring the degree of squashing of the weld points by a nondestructive dimensional check, visual for example, whereas welding or soldering between body and cup requires a destructive check in order to access the hidden part which is the subject of the said check.

Figure 3A:
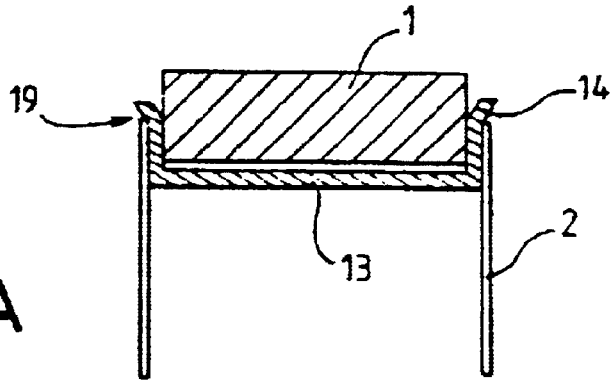
Figure 3B:
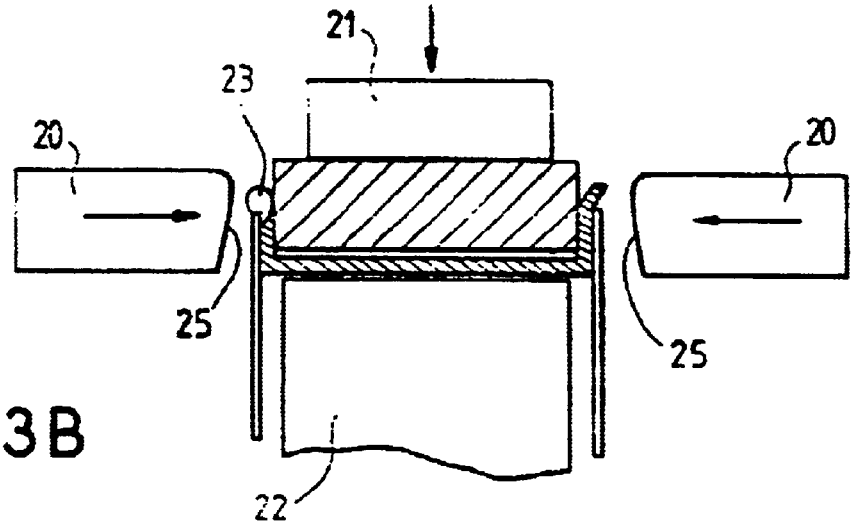
Figure 3C:
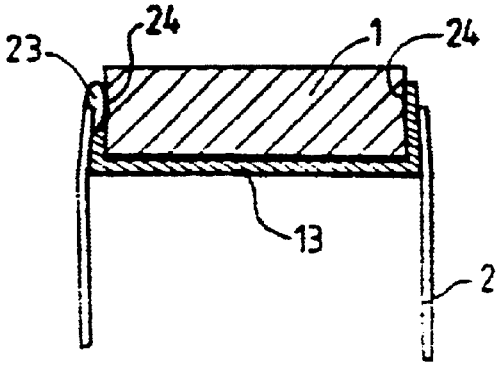

In an alternative embodiment, illustrated by FIGS. 3A to 3C, the crimping is performed with presser elements exhibiting an end profile 25 chosen in such a way that the collar of the cup bears on that zone around the end of the skirt 2 which is most squashed after crimping. Thus, the edges of the cup and the end of the skirt 2 locally push back the lateral surface of the emissive body in such a way that after crimping, the body exhibits on its lateral surface an indent-like deformation 24 caused by the penetration of the edges of the cup and of the skirt. This process has the advantage of allowing less critical welding of the skirt to the cup insofar as the indent 24 is no longer linked with the dimension of the bead 23 which can vary with the welding conditions or even of avoiding the welding phase itself.

The two preceding embodiments are not mutually exclusive and may advantageously be combined so as to improve the securing of the body in the cup.

During the crimping phase, the constituent porous material of the body will be compressed and it may be necessary to ensure that the surround of the constituent material of the cup absorbs this compression and can creep sufficiently during crimping, otherwise the compression exerted on the emissive body may cause the latter to break and may irretrievably damage the cathode.

The intrinsic property of porosity of the material of the body allows it to absorb part of the compression, resulting in a reduction in this porosity in the peripheral region. In addition, the creeping of the material of the cup will tend to fill in the interstices between the opposite surfaces of the body and of the cup. This creeping will therefore improve the contact between the body and the cup and consequently optimize the thermal transfer of the cathode. By virtue of the lower support 22, the thermal contact is also provided for between the body 1 and the cup 13.

In order for a considerable amount of the constituent material of the cup to be able to creep, it is possible to provide on the fixed support 22 a recess, disposed for example on the periphery of its surface, resulting in an indent-like zone 30, as illustrated by FIG. 4. This indent-like zone makes it possible to relieve the stresses and ensure a rigid cathode structure during the lifetime of the tube.

This method of assembling the constituent elements of the cathode has several other advantages. It does not require any phase of welding the emissive body to the cup and thus prevents the welding operation from damaging the impregnant contained in the body. It makes it possible to accept dimensional play between body and cup since the play is absorbed by the crimping; this play allows dimensional tolerances on the body and the cup thereby easing their manufacture. It reduces the number of assembling operations to two simple operations, welding followed by crimping, which operations are moreover capable of being carried out on one and the same machine. And, by improving the thermal transfer by conduction between the filament and the body through the cup, it reduces the start-up time of the cathode, an important commercial criterion in respect of cathode-ray tubes in which the cathodes thus assembled are the sources of electron beams.

What is claimed is:

1. A process for assembling a cathode for electron gun comprising a body of emissive material, a cup into which the body of emissive material is inserted, a substantially cylindrical metal skirt, the said process comprising the steps of:

insertion of the cup into one of the open ends of the metal skirt; and crimping of the body/cup/skirt assembly by lateral squeezing in such a way as to cause an indent-like deformation of the lateral face of the body.

2. A process for assembling a cathode for electron gun according to claim 1, further comprising a phase of welding the cup to the skirt, and the lateral squeezing occurring at the level of the cup to skirt weld zone.

3. A process for assembling a cathode for electron gun according to claim 2, wherein the indent-like deformation is carried out by squashing the weld points against the lateral face of the body.

4. An assembling process according to claim 2, wherein the welding of the cup to the skirt is carried out at at least three points.

5. A process for assembling a cathode for electron gun according to claim 1, wherein the indent-like deformation is carried out by a suitable profile of the presser elements effecting the crimping.

* * * * *